US005842250A

United States Patent [19]

Zhadanov

[11] Patent Number: 5,842,250

[45] Date of Patent: Dec. 1, 1998

[54] CLEANING DEVICE

[76] Inventor: Eli Zhadanov, 2942 W. 5th St., Brooklyn, N.Y. 11214

[21] Appl. No.: 856,738

[22] Filed: May 15, 1997

[51] Int. Cl.[6] ..... A47L 11/14

[52] U.S. Cl. ..... 15/230.14; 15/230; 451/359

[58] Field of Search ..... 15/97.1, 225, 226, 15/230, 230.14, 230.16, 230.19; 451/353, 359, 495

[56] References Cited

U.S. PATENT DOCUMENTS 1,617,838 2/1927 Fennell ..... 15/230.19

1,682,216 8/1928 Dellaree et al. ..... 15/230.19

1,796,787 3/1931 Hatfield ..... 15/230

2,311,135 2/1943 Steinmetz et al. ..... 15/230.16

*Primary Examiner*—Terrence R. Till

*Attorney, Agent, or Firm*—Ilya Zborovsky

[57] ABSTRACT

A cleaning device has a substantially conical outer element having an axis, an axially inner region and an axially outer region and being elastic so that at least the axially outer region is bendable to follow a shape of a surface to be cleaned when pressed against the surface.

8 Claims, 3 Drawing Sheets

CLEANING DEVICE

BACKGROUND OF THE INVENTION

The present invention relates generally to cleaning devices which can be used as a mit, a mophead, or a rotating attachment to water-powered or electrically powered rotary cleaning system.

Cleaning devices of the above mentioned general type are known in the art. A known cleaning device is formed as a disk.

SUMMARY OF THE INVENTION

Accordingly, it is an object of the present invention to provide a cleaning device which is a further improvement of the existing devices.

In keeping with these objects and with others which will become apparent hereinafter, one feature of present invention resides, briefly stated, in a cleaning device which has a substantially conical element having an axis, an axially inner region and an axially outer region and being elastic so that at least said axially outer region is bendable to follow a shape of a surface to be cleaned when pressed against the surface.

When the cleaning device is designed in accordance with the present invention, it has a longer service life under heavy cleaning conditions that sponges, foams, and fibers presently used for cleaning. It has a lower weight than the layered fabric cleaning devices which become heavy when they absorb water.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 3:
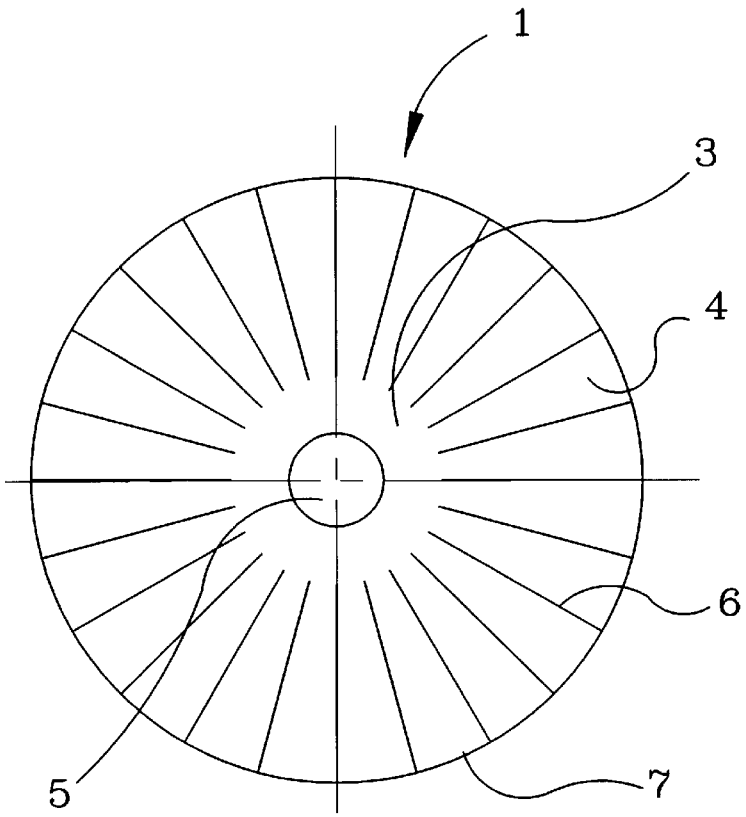
FIGS. 3 and 4 are a bottom view and a side view of the inner element of the cleaning device in the inoperative position.
Figure 4:
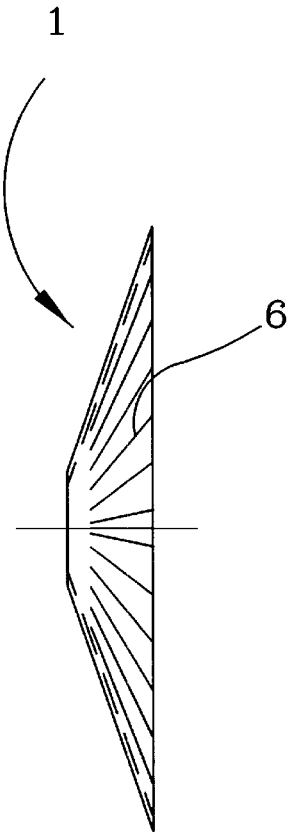
Figure 5:
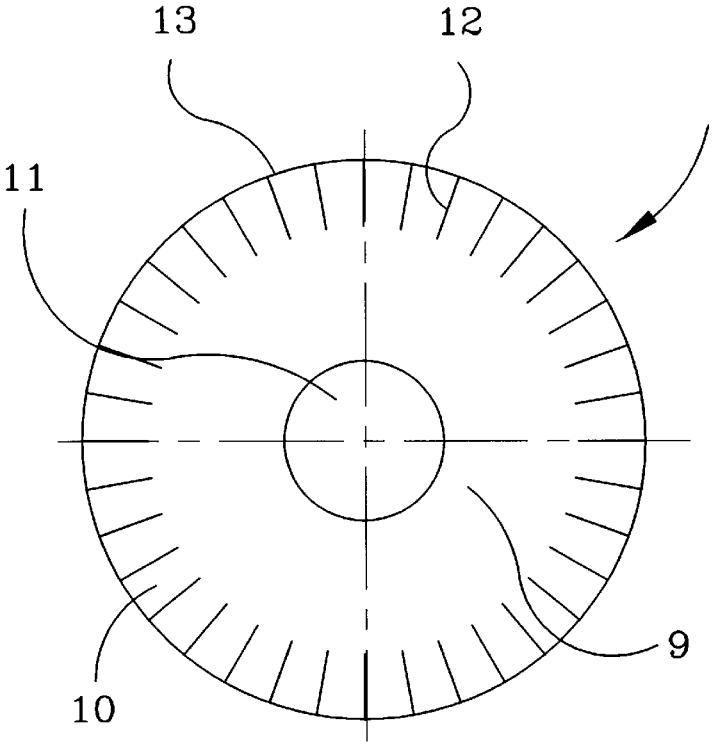
FIGS. 5 and 6 are a bottom view and a side view of the outer element of the cleaning device.
Figure 6:
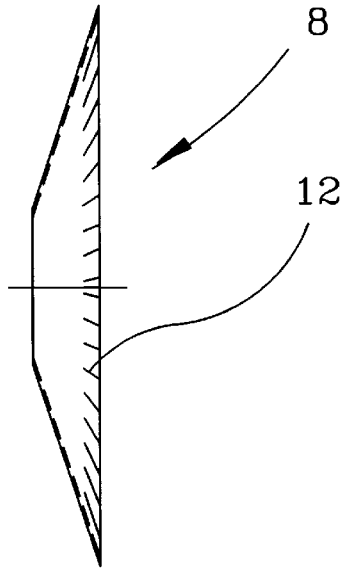
Figure 7:
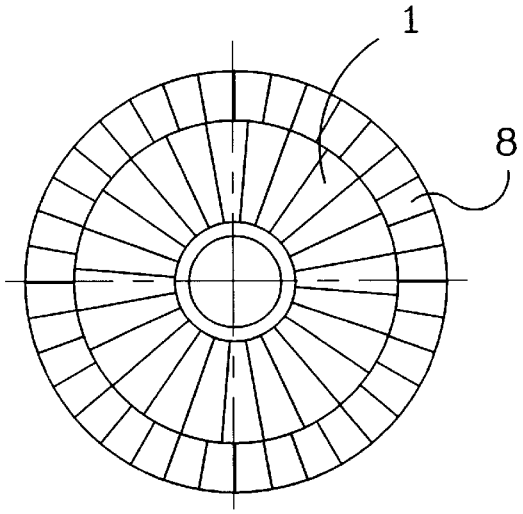
FIG. 7 is a view from below of the both elements.

A cleaning device in accordance with the present invention has an inner element which is identified as a whole with reference numeral 1. The inner element 1 is formed as a conical disk having a central axis 2. The conical disk 1 has an inner axial region 3 and an outer axial region 4. An opening 5 is provided in the inner axial region 3 of the conical element 1. As can be seen from FIG. 3, the inner element 1 is provided with a plurality of slots 6 which extend from an outer circumferential edge 7 through the axially outer region 4, and further toward the axially inner region 3, which region 3 is however not provided with the slots.

The cleaning device further has an outer element identified as a whole with reference numeral 8. The outer element 8 is conical and has an inner axial region 9 and an outer axial region 10 as well as a central opening 11 in the central axial region 9. A plurality of slots 12 are provided in the outer element 8 and extend from an outer circumferential edge through the outer axial region 10. As can be seen from FIGS. 1 and 2, the outer element 8 is longer than the inner element 1 so that the axially outer region 10 of the outer element 8 extends beyond the axially outer region 4 of the inner element 1. The slots 6 and 12 of the inner element 1 and the outer element 8 do not coincide with one another. The elements 1 and 8 are connected with one another by holding means which include an outer holding member 14 and an inner holding member 15. The outer holding member 14 is substantially cylindrical. It has a central opening 16 and a conical portion 17 arranged over the outer element 8. The inner holding member 15 has a central opening 17' and a flange 18 projecting radially and located inside the inner element 1. The outer holding member 14 and the inner holding member 15 are connected with one another for example by a welding seam 19 so as to firmly clamp the elements 1 and 8 together between the holding members 14 and 15.

Figure 1:
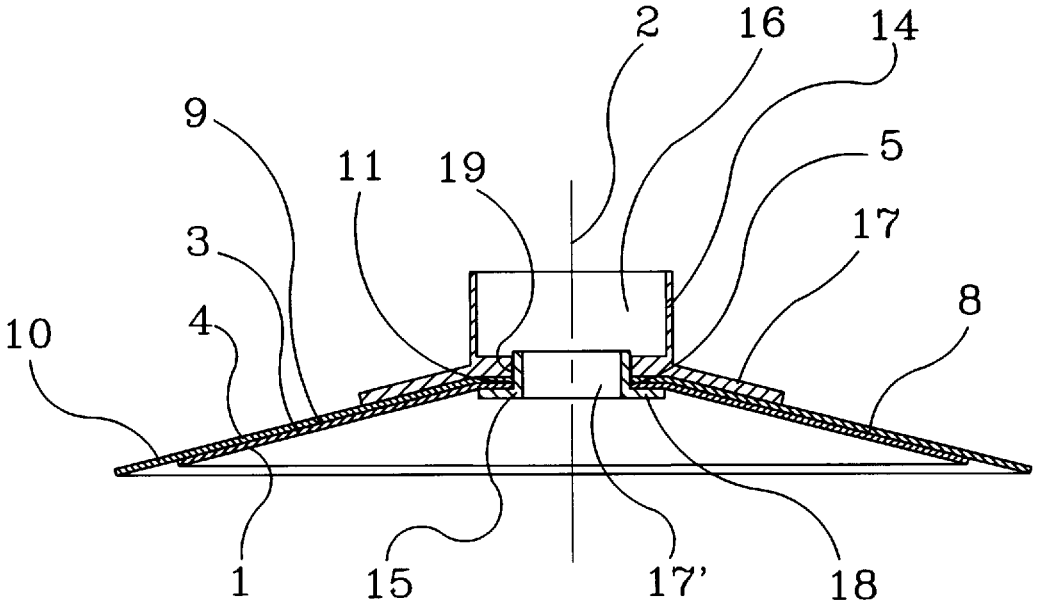
FIG. 1 is a view showing a section of a cleaning device in accordance with the present invention in an inoperative position.
Figure 2:
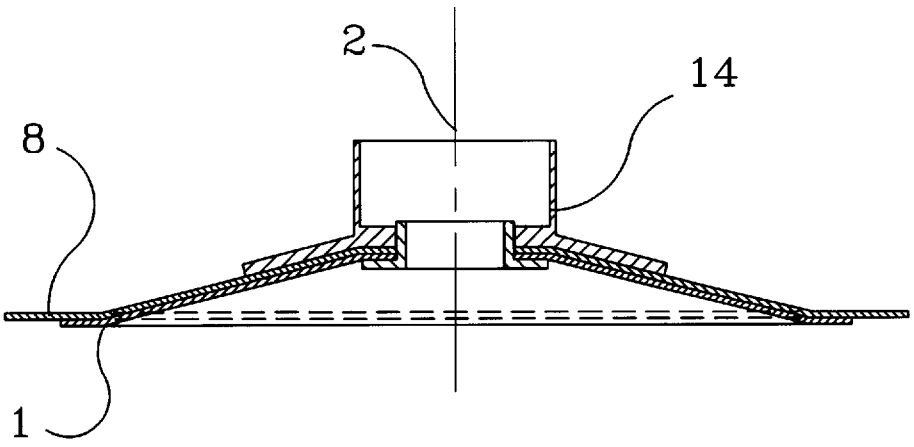
FIG. 2 is a view showing the inventive cleaning device in an operative position when it is pressed against an object to be cleaned.

The operation of the inventive cleaning device is shown in FIG. 2. When the cleaning device is pressed against surface to be cleaned, the axially outer regions 4 and 10 of the inner element and the outer element 8 are bent and the lower surface of the inner element 1 in FIG. 1 provides a cleaning action. In some cases when there are some areas which are hard to reach, the outwardly projecting axially outer region 10 of the outer element 8 also performs a cleaning action. The bending of the axially outer regions 4 and 10 of the elements 1 and 8 is facilitated by the slots 6 and 12. Since the slots 6 of the inner element 1 are substantially long, the inner element 1 can adopt to the shape of any surface to be cleaned. The outer element 8 provides a pressing action since it is harder than the inner element 1. The materials of the elements are selected so that the inner element 1 is more elastic and bendable, while the outer element 8 is less elastic and more rigid to provide a pressing action and to operate as a spring to hold the inner element 1 against a surface to be cleaned. The inner element can be composed of fabric, plastic, and other materials, the outer element 8 can be also composed of fabric, plastic, rubber, spring, steel, etc. The central opening of the device produced by a combination of the central openings 16 and 17' define a liquid passage way and is utilized for supplying a washing medium. Additional elements similar to the elements 1 and 8 can be provided as well. The lower surface of the element 1 which is applied against a surface to be cleaned can be additionally coated if necessary.

The slots 6 of the inner element 1 and the slots 12 of the outer element 8 can coincide with one another.

It will be understood that each of the elements described above, or two or more together, may also find a useful application in other types of constructions differing from the types described above.

While the invention has been illustrated and described as embodied in a cleaning device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cleaning device, comprising a substantially conical element having an axis, an axially inner region and an axially outer region and being elastic so that at least said axially outer region is bendable to follow a shape of a surface to be cleaned when pressed against the surface, said substantially conical element having a throughgoing opening, defining a liquid passage way, surrounding said axis in said axially inner region.

2. An cleaning device as defined in claim 1, wherein said element is an inner element; and further comprising an outer element having an axially inner region and an axially outer region, at least said axially outer region being bendable, said inner element and said outer element being provided with a throughgoing opening surrounding said axis in said axially inner regions of said inner element and said outer element.

3. An cleaning device as defined in claim 2, wherein said axially outer region of said outer element extends outwardly beyond said axially outer region of said inner element.

4. An cleaning device as defined in claim 2, wherein said outer element has a plurality of slots which are spaced from one another in a circumferential direction and extend from an edge of said outer element toward said axis.

5. An cleaning device as defined in claim 4, wherein said inner element has a plurality of slots which are spaced from one another in a circumferential direction and extend from an outer edge of said inner element over said axially outer region and further toward said axis with the exception of said axially inner region.

6. An cleaning device as defined in claim 5, wherein said slots of said inner element and said slots of said outer element do not coincide with one another.

7. A device as defined in claim 1; and further comprising holding means including an outer holding member applied on said outer element and an inner holding member applied on said inner element and connected with said outer holding member, said outer element, said inner element, said outer holding member and said inner holding member being provided each with a throughgoing opening.

8. A cleaning device, comprising a substantially conical element having an axis, an axially inner region and an axially outer region and being elastic so that at least said axially outer region is bendable to follow a shape of a surface to be cleaned when pressed against the surface; and further comprising, said element being an inner element; an outer element having an axially inner region and an axially outer region, at least said axially outer region being bendable; and holding means including an outer holding member applied on said outer element and an inner holding member applied on said inner element and connected with said outer holding member, said outer holding member having a conical portion applied over said inner axial region of said outer element, said inner holding member having a radial flange applied on said inner element.

* * * * *